US012421647B2

(12) United States Patent
Lee et al.

(10) Patent No.: US 12,421,647 B2
(45) Date of Patent: Sep. 23, 2025

(54) WASHING MACHINE AND CONTROLLING METHOD FOR THE SAME

(71) Applicant: SAMSUNG ELECTRONICS CO., LTD., Suwon-si (KR)

(72) Inventors: Seunghun Lee, Suwon-si (KR); Junhyun Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 299 days.

(21) Appl. No.: 17/955,831

(22) Filed: Sep. 29, 2022

(65) Prior Publication Data

US 2023/0175191 A1 Jun. 8, 2023

Related U.S. Application Data

(63) Continuation of application No. PCT/KR2022/012844, filed on Aug. 27, 2022.

(30) Foreign Application Priority Data

Dec. 8, 2021 (KR) ..... 10-2021-0174624

(51) Int. Cl.
*D06F 39/08* (2006.01)
*D06F 23/02* (2006.01)
(Continued)

(52) U.S. Cl.
CPC ..... *D06F 39/087* (2013.01); *D06F 23/02* (2013.01); *D06F 23/04* (2013.01); *D06F 33/34* (2020.02);
(Continued)

(58) Field of Classification Search
CPC ..... D06F 39/087; D06F 23/02; D06F 23/04; D06F 33/34; D06F 34/06; D06F 34/18;
(Continued)

(56) References Cited

U.S. PATENT DOCUMENTS 5,671,493 A 9/1997 Moon
7,287,292 B2 10/2007 Kim
(Continued)

FOREIGN PATENT DOCUMENTS

CN 113564870 A 10/2021
CN 114575094 A * 6/2022
(Continued)

OTHER PUBLICATIONS

CN114575094 translation (Year: 2022).*
(Continued)

*Primary Examiner* — Michael E Barr
*Assistant Examiner* — Lauren G Orta
(74) *Attorney, Agent, or Firm* — STAAS & HALSEY LLP

(57) ABSTRACT

A washing machine capable of determining an accurate state of a water supplier during a water supply course includes a tub; a drum rotationally arranged in the tub; a driving motor configured to rotate the drum; a water supplier configured to supply water into the tub; a water level sensor configured to measure a water level in the tub; and a controller configured to control the driving motor to perform a first weight detection course before water supply is started, and control the driving motor to perform a second weight detection course based on the water level in the tub being less than a preset water level when a predetermined time has elapsed after the water supply into the tub is started.

15 Claims, 15 Drawing Sheets

(51) Int. Cl.

| | |
|---|---|
| ***D06F 23/04*** | (2006.01) |
| ***D06F 33/34*** | (2020.01) |
| ***D06F 33/44*** | (2020.01) |
| ***D06F 33/47*** | (2020.01) |
| ***D06F 34/06*** | (2020.01) |
| ***D06F 34/18*** | (2020.01) |
| ***D06F 34/22*** | (2020.01) |
| ***D06F 34/32*** | (2020.01) |
| ***D06F 34/34*** | (2020.01) |
| ***D06F 37/30*** | (2020.01) |
| *D06F 103/04* | (2020.01) |
| *D06F 103/14* | (2020.01) |
| *D06F 103/18* | (2020.01) |
| *D06F 105/02* | (2020.01) |
| *D06F 105/46* | (2020.01) |
| *D06F 105/56* | (2020.01) |
| *D06F 105/58* | (2020.01) |

(52) U.S. Cl.
CPC ..... *D06F 34/06* (2020.02); *D06F 34/18* (2020.02); *D06F 34/32* (2020.02); *D06F 37/304* (2013.01); *D06F 39/088* (2013.01); *D06F 2103/04* (2020.02); *D06F 2103/14* (2020.02); *D06F 2103/18* (2020.02); *D06F 2105/02* (2020.02); *D06F 2105/46* (2020.02); *D06F 2105/56* (2020.02); *D06F 2105/58* (2020.02)

(58) Field of Classification Search
CPC ..... D06F 34/32; D06F 37/304; D06F 39/088; D06F 2103/04; D06F 2103/14; D06F 2103/18; D06F 2105/02; D06F 2105/46; D06F 2105/56; D06F 2105/58; D06F 34/22; D06F 33/47; D06F 39/08; D06F 33/44; D06F 34/34
See application file for complete search history.

(56) References Cited

U.S. PATENT DOCUMENTS

| | | | | |
|---|---|---|---|---|
| 9,863,076 | B2 | 1/2018 | Leonard et al. | |
| 10,465,324 | B1 | 11/2019 | Dillon et al. | |
| 2004/0006831 | A1 | 1/2004 | Kim et al. | |
| 2012/0210518 | A1 | 8/2012 | Bae et al. | |
| 2015/0121631 | A1 | 5/2015 | Kang | |
| 2018/0002856 | A1* | 1/2018 | Hombroek | D06F 39/087 |
| 2020/0102690 | A1 | 4/2020 | Patri et al. | |
| 2020/0109504 | A1* | 4/2020 | Im | D06F 34/18 |
| 2021/0017686 | A1* | 1/2021 | Chang | D06F 34/18 |
| 2021/0207306 | A1 | 7/2021 | Koo et al. | |

FOREIGN PATENT DOCUMENTS

| | | | | |
|---|---|---|---|---|
| JP | 3075886 | | 8/2000 | |
| JP | 2011-217966 | | 11/2011 | |
| JP | 2019-84340 | | 6/2019 | |
| JP | 2020-175187 | | 10/2020 | |
| JP | 2020175187 A | * | 10/2020 | D06F 33/34 |
| KR | 10-1995-0014445 | | 6/1995 | |
| KR | 10-1995-0023777 | | 8/1995 | |
| KR | 0147743 | | 2/1996 | |
| KR | 10-1997-0027445 | | 6/1997 | |
| KR | 1999-0051601 | | 7/1999 | |
| KR | 10-1082885 | | 11/2011 | |
| KR | 10-1270608 | | 6/2013 | |
| KR | 10-1460540 | | 11/2014 | |
| KR | 10-1462172 | | 11/2014 | |
| KR | 10-2015-0052697 | | 5/2015 | |
| KR | 10-2021-0088956 | | 7/2021 | |

OTHER PUBLICATIONS

JP2020175187 translation (Year: 2020).*
International Search Report dated Dec. 21, 2022 in International Patent Application No. PCT/KR2022/012844 (3 pages; 3 pages English translation).
PCT/ISA/237 dated Dec. 21, 2022 in International Patent Application No. PCT/KR2022/012844 (4 pages).
Supplementary European Search Report dated Oct. 16, 2024 issued in EP Application No. EP 22 90 4395.

* cited by examiner

FIG. 12

| DIFFERENCE(f) | STATE OF WATER SUPPLIER |
|---|---|
| $\lvert f \rvert < V1$ | ERROR |
| $V1 < \lvert f \rvert < V2$ | LOW WATER PRESSURE (FIRST LEVEL) |
| $V2 < \lvert f \rvert < V3$ | LOW WATER PRESSURE (SECOND LEVEL) |
| $V3 < \lvert f \rvert < V4$ | LOW WATER PRESSURE (THIRD LEVEL) |
| ⋮ | ⋮ |

WASHING MACHINE AND CONTROLLING METHOD FOR THE SAME

CROSS-REFERENCE TO RELATED APPLICATION(S)

This application is a continuation application, under 35 U.S.C. § 111(a), of International Application No. PCT/KR2022/012844, filed on Aug. 27, 2022, which claims priority to Korean Patent Application No. 10-2021-0174624, filed on Dec. 8, 2021 in the Korean Intellectual Property Office, the disclosures of which are incorporated by reference herein in their entirety.

1. FIELD

The disclosure relates to a washing machine and method for controlling the same, and more particularly, to a washing machine and method for controlling the same capable of preventing an error in diagnosis of a water supplier in a low water pressure environment.

2. DESCRIPTION OF RELATED ART

In general, the washing machine may include a tub for storing water for laundry and a drum rotationally installed in the tub. The washing machine may do laundry by rotating the drum that contains clothes.

The washing machine may perform a washing process for washing the clothes, a rinsing process for rinsing the washed clothes, and a dehydrating process for dehydrating the clothes. The washing machine supplies water into the tub in the washing process and the rinsing process to perform washing and rinsing of the clothes, and performs a draining course to drain the water used for washing and rinsing.

A water supply course may refer to a course for supplying water into the tub by operating the water supplier of the washing machine.

When the washing machine is used in a low water pressure environment, it may be determined that water is not being supplied despite the fact that the water is actually being supplied, so the laundry cycle may be terminated, causing inconvenience to the user who uses the washing machine in the low water pressure environment.

SUMMARY

According to an aspect of the disclosure, a washing machine comprising a tub; a drum in the tub; a motor to rotate the drum within the tub; a water supplier to supply water into the tub; a water level sensor to measure a water level in the tub; and a controller configured to control the motor to perform a first weight detection course which obtains a first weight value before water supply into the tub is started, and control the motor to perform a second weight detection course which obtains a second weight value based on the water level in the tub being less than a preset water level when a predetermined time has elapsed after the water supply into the tub is started.

The controller may determine a state of the water supplier based on a difference between the first weight value and the second weight value.

The washing machine may further include a display, and the controller may control the display to output a visual indication indicating an error in the water supplier based on a difference between the first weight value and the second weight value being equal to or smaller than a preset value.

The controller may control the water supplier to stop supplying water based on a difference between the first weight value and the second weight value being equal to or smaller than a preset value.

The display may display a remaining time of a laundry cycle performed by the washing machine, and the controller may adjust a remaining time displayed on the display based on a difference between the first weight value and the second weight value.

The controller may control the display to output a visual indication indicating a low water pressure of the water supplier based on a difference between the first weight value and the second weight value being greater than a first preset value and smaller than a second preset value.

The controller may control the water supplier to continue to supply water based on a difference between the first weight value and the second weight value being greater than a preset value.

The controller may control the motor to perform a third weight detection course based on the water level in the tub being less than the preset water level when the predetermined time has elapsed after the second weight detection course is completed.

The controller may control the driving motor to perform a weight detection course in every preset cycle in every cycle until the water level in the tub after the start of water supply reaches the preset water level.

The controller may determine a state of the water supplier based on the water level value measured by the water level sensor in response to the water level in the tub reaching the preset water level.

According to an aspect of the disclosure, a method of controlling a washing machine includes controlling a motor to perform a first weight detection course which obtains a first weight value before water supply into the tub is started; and controlling the motor to perform a second weight detection course which obtains a second weight value based on the water level in the tub being less than a preset water level when a predetermined time has elapsed after the water supply into the tub is started.

The method of controlling the washing machine may further include determining a state of the water supplier based on a difference between a first weight value and a second weight value.

The method of controlling the washing machine may further include outputting a visual indication indicating an error in a water supplier based on a difference between a first weight value and a second weight value being equal to or smaller than a preset value.

The method of controlling the washing machine may further include stopping supplying water based on a difference between a first weight value and a second weight value being equal to or smaller than a preset value.

The method of controlling the washing machine may further include displaying a remaining time of a laundry cycle being performed by the washing machine; and adjusting the remaining time based on a difference between a first weight value and a second weight value.

The method of controlling the washing machine may further include outputting a visual indication indicating a low water pressure of the water supplier based on the difference between the first weight value obtained from the first weight detection course and the second weight value obtained from the second weight detection course being greater than a first preset value and smaller than a second preset value.

The method of controlling the washing machine may further include continuing to supply water based on the difference between the first weight value obtained from the first weight detection course and the second weight value obtained from the second weight detection course being greater than a preset value.

The method of controlling the washing machine may further include controlling the driving motor to perform a third weight detection course based on the water level in the tub being less than the preset water level when the predetermined time has elapsed after the second weight detection course is completed.

The method of controlling the washing machine may further include determining a water pressure level of the water supplier based on a water level value measured by a water level sensor in response to the water level in the tub reaching the preset water level.

According to an aspect of the disclosure, a washing machine includes a tub; a drum rotationally arranged in the tub; a driving motor configured to rotate the drum; a water supplier configured to supply water into the tub; a water level sensor configured to measure a water level in the tub; and a controller configured to control the driving motor to perform a first weight detection course before water supply is started and control the driving motor to perform a second weight detection course based on passage of a preset time after the start of water supply and failure of the water level in the tub to reach a preset water level.

According to the disclosure, the user may perceive a correct time required for a laundry cycle.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 12 illustrates an example of states of a water supplier depending on difference values between weight values.

DETAILED DESCRIPTION

Figure 1:
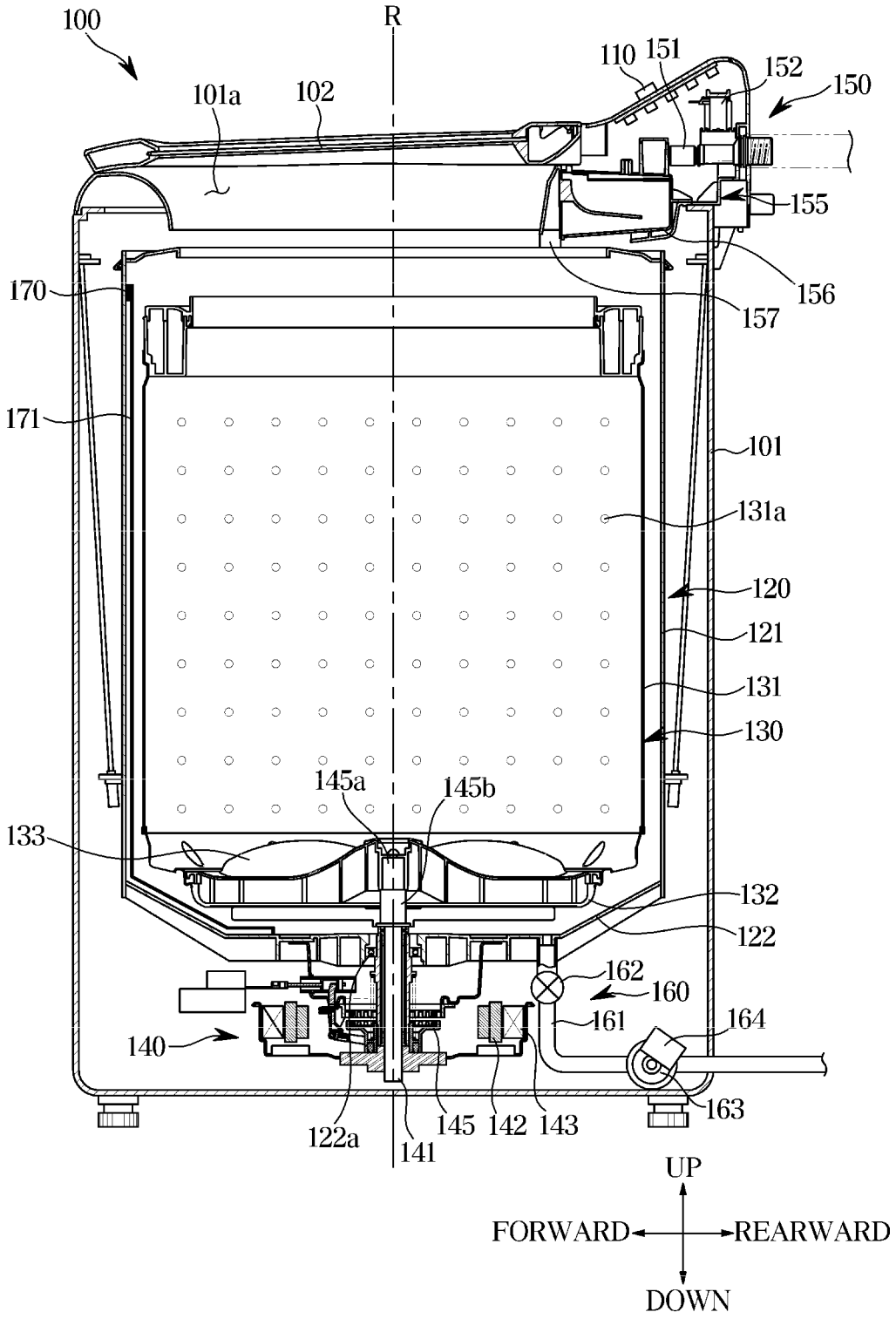
FIG. 1 illustrates an example of a washing machine, according to an embodiment.

Embodiments and features as described and illustrated in the disclosure are merely examples, and there may be various modifications replacing the embodiments and drawings at the time of filing this application.

The terminology used herein is for the purpose of describing particular embodiments only and is not intended to limit the present disclosure.

For example, the singular forms "a", "an" and "the" as herein used are intended to include the plural forms as well, unless the context clearly indicates otherwise.

The terms "comprises" and/or "comprising," when used in this specification, represent the presence of stated features, integers, steps, operations, elements, components or combinations thereof, but do not preclude the presence or addition of one or more other features, integers, steps, operations, elements, components, or combinations thereof.

The term including an ordinal number such as "first", "second", or the like is used to distinguish one component from another and does not restrict the former component.

Furthermore, the terms, such as "~part", "~block", "~member", "~module", etc., may refer to a unit of handling at least one function or operation. For example, the terms may refer to at least one process handled by hardware such as a field-programmable gate array (FPGA)/application specific integrated circuit (ASIC), etc., software stored in a memory, or at least one processor.

The disclosure provides a washing machine and a method for controlling the same capable of determining an accurate state of a water supplier during a water supply course.

According to the disclosure, an accurate decision may be made as to whether a water supplier is being operated even in a very low water level state of a tub.

According to the disclosure, an accurate water pressure level of a water supplier may be determined even in a very low water level state of a tub.

According to the disclosure, a correct time required for a laundry cycle may be quickly determined even in a very low water level state of a tub.

According to the disclosure, a time required for a laundry cycle may be quickly adjusted depending on a water pressure level of a water supplier.

An embodiment of the disclosure will now be described in detail with reference to accompanying drawings. Throughout the drawings, like reference numerals or symbols refer to like parts or components.

The working principle and embodiments of the disclosure will now be described with reference to accompanying drawings.

Figure 2:
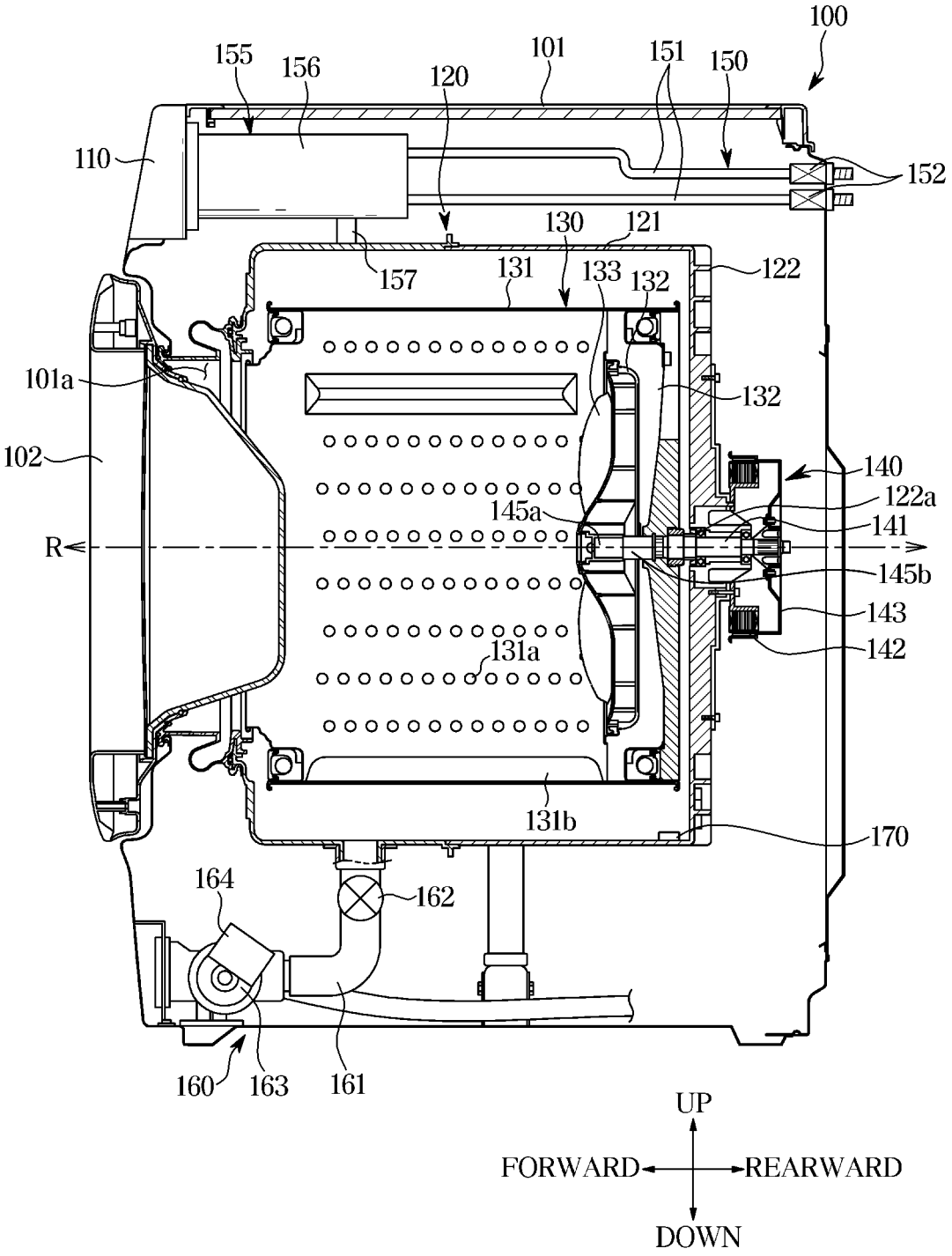
FIG. 2 illustrates another embodiment of a washing machine, according to an embodiment.
Figure 3:
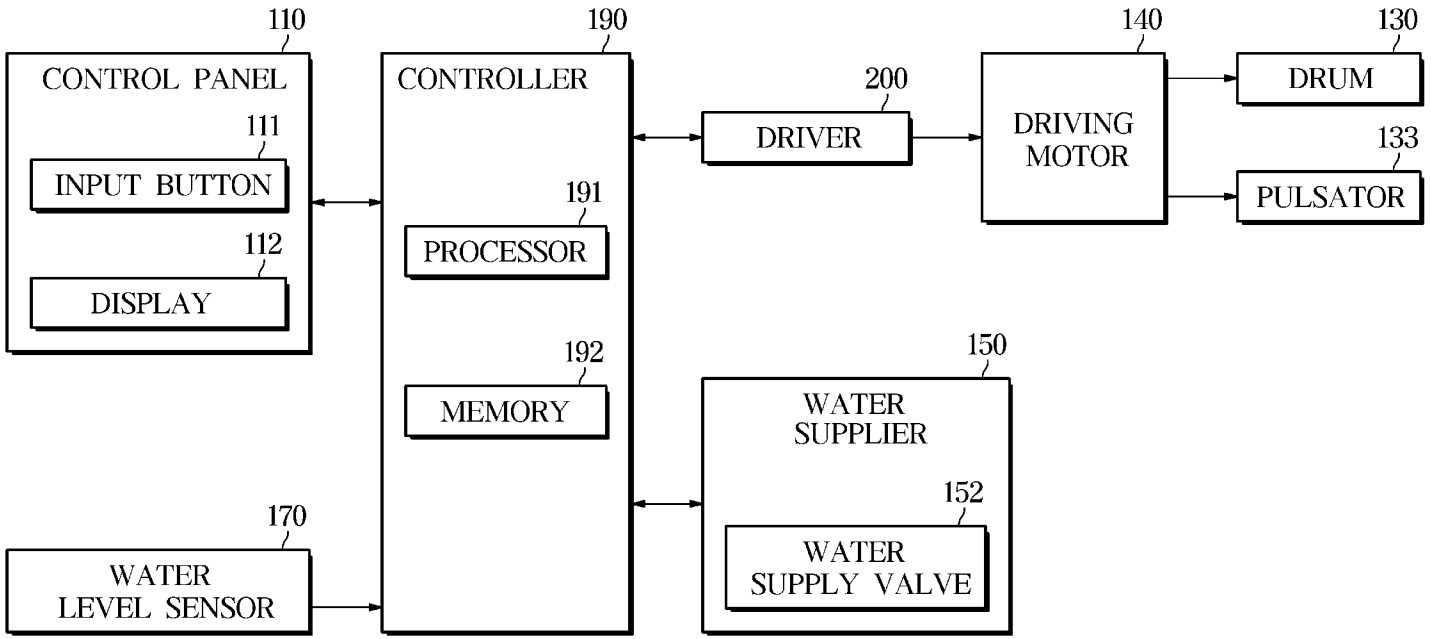
FIG. 3 is a block diagram illustrating a configuration of a washing machine, according to an embodiment.

FIG. 1 illustrates an example of a washing machine, according to an embodiment. FIG. 2 illustrates another embodiment of a washing machine, according to an embodiment. FIG. 3 is a block diagram illustrating a configuration of a washing machine, according to an embodiment.

Referring to FIGS. 1, 2 and 3, a washing machine 100 may include a control panel 110, a washing tub 120 and 130, a driving motor 140, a water supplier 150, a detergent supplier 155, a drain 160, a driver 200, a water level sensor 170 and a controller 190.

The washing machine 100 may include a cabinet 101 to accommodate the components included in the washing machine 100. The cabinet 101 may accommodate the control panel 110, the water level sensor 170, the driver 200, the driving motor 140, the water supplier 150, the drain 160, the detergent supplier 155 and the washing tub 120 and 130.

An opening 101*a* is formed on one side of the cabinet 101 for drawing in or out the laundry.

For example, the washing machine 100 may include a top-loading washing machine with the inlet 101*a*, through which to draw in or out the laundry, formed on the top side of the cabinet 101 as shown in FIG. 1, or a front-loading washing machine with the inlet 101*a*, through which to draw in or out the laundry, formed on the front side of the cabinet 101 as shown in FIG. 2. In the embodiment, the washing machine 100 is not limited to the top-loading washing machine or the front-loading washing machine, but may correspond to any of the top-loading washing machine and the front-loading washing machine. Of course, the washing machine 100 may include any loading type of washing machine other than the top-loading washing machine and the front-loading washing machine.

A door 102 is arranged on one side of the cabinet 101 to open or close the inlet 101*a*. The door 101 may be arranged on the same surface as the inlet 101*a* and installed on the cabinet 101 to pivot on a hinge.

The control panel 110 may be arranged on one surface of the cabinet 101 to provide a user interface for interacting with the user.

The control panel 110 may include, for example, an input button 111 for obtaining a user input, and a display 112 for displaying a laundry setting or laundry operation information in response to the user input.

The input button 111 may include, for example, a power button, an operation button, a course selection dial (or course selection buttons) and washing/rinsing/dehydrating setting buttons. The input button may include, for example, a tact switch, a push switch, a slide switch, a toggle switch, a micro switch, or a touch switch.

The input button 111 may provide an electric output signal corresponding to the user input to the controller 190.

The display 112 may include a screen for displaying a laundry course selected by turning the course selection dial (or by pressing the course selection button) and an operation time of the washing machine 100, and an indicator for indicating a washing setting/rinsing setting/dehydration setting selected by the setting button. The display 112 may include, for example, a liquid crystal display (LCD) panel 112, a light emitting diode (LED) panel, or the like.

The display 112 may receive information to be displayed from the controller 190 and display information corresponding to the received information.

The washing tub 120 and 130 may be arranged in the cabinet 101.

The washing tub 120 and 130 may include a tub 120 for receiving water for washing and rinsing, and a drum 130 rotationally equipped in the tub 120 to accommodate clothes.

The tub 120 may have the shape of e.g., a cylinder with a bottom surface open. The tub 120 may include a tub bottom surface 122 shaped almost like a circle and a tub side wall 121 provided along the circumference of the tub bottom surface 122. Another bottom surface of the tub 120 may be opened to draw in or draw out clothes or may have an opening formed thereon.

In the case of the top-loading washing machine, as shown in FIG. 1, the tub 120 may be arranged with the tub bottom surface 122 facing the bottom of the washing machine 100 and a center axis R of the tub side wall 121 being substantially perpendicular to the floor. In the case of the front-loading washing machine, as shown in FIG. 2, the tub 120 may be arranged with the tub bottom surface 122 facing the back of the washing machine 100 and the center axis R of the tub side wall 121 being substantially parallel to the floor.

A bearing 122*a* may be arranged on the tub bottom surface 122 to rotationally fix the driving motor 140.

The drum 130 may be rotationally arranged in the tub 120. The drum 130 may accommodate clothes, i.e., loads.

The drum 130 may have the shape of e.g., a cylinder with a bottom surface open. The drum 130 may include a drum bottom surface 132 shaped almost like a circle and a drum side wall 131 provided along the circumference of the drum bottom surface 132. Another bottom surface of the drum 130 may be opened to draw clothes into or out of the drum 130 or may have an opening formed thereon.

In the case of the top-loading washing machine, as shown in FIG. 1, the drum 130 may be arranged with the drum bottom surface 132 facing the bottom of the washing machine 100 and the center axis R of the drum side wall 131 being substantially perpendicular to the floor. In the case of the front-loading washing machine, as shown in FIG. 2, the drum 130 may be arranged with the drum bottom surface 132 facing the back of the washing machine 100 and the center axis R of the drum side wall 131 being substantially parallel to the floor.

On the drum side wall 131, through holes 131*a* may be formed to connect the inside and outside of the drum 130 for water supplied to the tub 120 to flow into the drum 130.

In the case of the top-loading washing machine as shown in FIG. 1, a pulsator 133 may be rotationally provided on the inner side of the drum bottom surface 132. The pulsator 133 may be rotated separately from the drum 130. In other words, the pulsator 133 may be rotated in the same direction as or different direction from the drum 130. The pulsator 133 may be rotated at the same rotation speed as or a different rotation speed from the drum 130.

In the case of the front-loading washing machine as shown in FIG. 2, a lifter 131*b* is provided on the drum side wall 131 to lift clothes up the drum 130 while the drum 130 is being rotated. Furthermore, in various embodiments, even for the front-loading washing machine, the pulsator 133 may be rotationally arranged on the inner side of the drum bottom surface 132. The pulsator 133 may be rotated separately from the drum 130. In other words, the pulsator 133 may be rotated in the same direction as or different direction from the drum 130. The pulsator 133 may be rotated at the same rotation speed as or a different rotation speed from the drum 130.

The drum bottom surface 132 may be connected to a rotation shaft 141 of the driving motor 140 that rotates the drum 130.

The driving motor 140 may rotate the drum 130 and/or the pulsator 133 included in the washing tub 120 and 130 based on a driving current applied from the driver 200.

In an embodiment, the driving motor 140 may produce torque to rotate the drum 130 and/or the pulsator 133.

The driving motor 140 may be arranged on the outer side of the tub bottom surface 122 of the tub 120, and connected to the drum bottom surface 132 of the drum 130 through the rotation shaft 141. The rotation shaft 141 may penetrate the tub bottom surface 122, and may be rotationally supported by the bearing 122*a* arranged on the tub bottom surface 122.

The driving motor 140 may include a stator 142 fixed onto the outer side of the tub bottom surface 122, and a rotor 143 arranged to be rotatable against the tub 120 and the stator 142. The rotor 143 may be connected to the rotation shaft 141.

The rotor 143 may be rotated by magnetic interaction with the stator 142, and the rotation of the rotor 143 may be delivered to the drum 130 through the rotation shaft 141.

The driving motor 140 may include e.g., a brush-less direct current (BLDC) motor or a permanent synchronous motor (PMSM) capable of easily controlling the rotation speed.

In the case of the top-loading washing machine as shown in FIG. 1, there may be a clutch 145 for delivering the torque of the driving motor 140 to both the pulsator 133 and the drum 130, the drum 130, or the pulsator 133. The clutch 145 may be connected to the rotation shaft 141. The clutch 145 may distribute the rotation of the rotation shaft 141 to an inner shaft 145*a* and an outer shaft 145*b*. The inner shaft 145*a* may be connected to the pulsator 133. The outer shaft 145*a* may be connected to the drum bottom surface 132. The clutch 145 may deliver the rotation of the rotation shaft 141 to both the pulsator 133 and the drum 130 through the inner shaft 145*a* and the outer shaft 145*b*, deliver the rotation of the rotation shaft 141 to the drum 130 through the outer shaft 145*b*, or deliver the rotation of the rotation shaft 141 only to the pulsator 133 through the inner shaft 145*a*.

In the case of the front-loading washing machine as shown in FIG. 2, the driving motor 140 may rotate both the pulsator 133 and the drum 130, or the pulsator 133 or the drum 130.

In various embodiments, the driving motor 140 may be a dual-rotor motor equipped with an outer rotor and an inner rotor on the outer side and the inner side in a radial direction of one stator.

The inner rotor and the outer rotor of the driving motor 140 may be connected to the pulsator 133 and the drum 130 through the inner shaft 145*a* and the outer shaft 145*b*, respectively, and may drive the pulsator 133 and the drum 130 directly.

However, a method of driving the drum 130 and the pulsator 133 is not limited according to the type of the washing machine 100 (front-loading washing machine or top-loading washing machine), and even for the top-loading washing machine, the dual-rotor motor may be used for the driving motor 140 to rotate the pulsator 133 and the drum 130 separately, and even for the front-loading washing machine, the one stator 142, the one rotor 143, and the clutch 145 may be used to rotate the pulsator 133 and the drum 130 separately.

In various embodiments, the driving motor 140 may include a first driving motor for rotating the drum 130 and a second driving motor for rotating the pulsator 133.

The water supplier 150 may supply water to the tub 120 and the drum 130. The water supplier 150 includes a water supply conduit 151 connected to an external water source to supply water to the tub 120, and a water supply valve 152 arranged in the water supply conduit 151. The water supply conduit 151 may be arranged above the tub 120 and may extend to a detergent container 156 from the external water source. The water is guided to the tub 120 via the detergent container 156. The water supply valve 152 may allow or block the supply of water to the tub 120 from the external water source in response to an electric signal. The water supply valve 152 may include, for example, a solenoid valve that is opened or closed in response to an electric signal.

The detergent supplier 155 may supply a detergent to the tub 120 and the drum 130. The detergent supplier 155 is arranged above the tub 120 and includes the detergent container 156 and a mixing conduit 157 that connects the detergent container 156 to the tub 120. The detergent container 156 may be connected to the water supply conduit 151, and the water supplied through the water supply conduit 151 may be mixed with the detergent in the detergent container 156. The mixture of the detergent and the water may be supplied to the tub 120 through the mixing conduit 157.

The drain 160 may drain out the water stored in the tub 120 or the drum 130. The drain 160 may include a drain conduit 161 arranged below the tub 120 and extending to the outside of the cabinet 101 from the tub 120. The drain 160 may further include a drain valve 162 arranged in the drain conduit 161. The drain 160 may further include a drain pump 163 arranged in the drain conduit 161 and a pump motor 164 for operating the drain pump 163. The pump motor 164 may generate rotational force to create a difference in pressure between both sides of the drain pump 163, and the difference in pressure may make the water stored in the tub 120 discharged outside through the drain conduit 161.

The pump motor 164 may produce the rotational force based on a driving current applied from a pump motor driver (not shown).

The pump motor 164 may include, for example, a BLDC motor or a PMSM capable of easily controlling the rotation speed.

In the case of the top-loading washing machine as shown in FIG. 1, the water level sensor 170 may be installed at an end of a connecting hose 171 connected to the bottom of the tub 120. In this case, a water level in the connecting hose 171 may be equivalent to a water level in the tub 120. As the water level in the tub 120 increases, the water level in the connecting hose 171 increases, and due to the increase of the water level in the connecting hose 171, internal pressure of the connecting hose 171 may increase.

The water level sensor 170 may measure pressure in the connecting hose 171 and output an electric signal corresponding to the measured pressure to the controller 190. The controller 190 may identify a water level in the connecting hose 171, i.e., a water level in the tub 120, based on the pressure in the connecting hose 171 measured by the water level sensor 170.

For example, the water level sensor 170 may detect a frequency changing by the water level when the drum 130 is rotated.

In an embodiment, the controller 190 may identify the water level in the tub 120 by analyzing a frequency (water level frequency) of the electric signal corresponding to the pressure measured by the water level sensor 170.

In the case of the front-loading washing machine as shown in FIG. 2, the water level sensor 170 may be installed on the inner side of the bottom of the tub 120. As the water level in the tub 120 increases, the pressure applied to the water level sensor 170 increases, and accordingly, the water level sensor 170 may detect a frequency changing by the water level when the drum 130 rotates.

In an embodiment, the controller 190 may identify the water level in the tub 120 by analyzing a frequency (water level frequency) of the electric signal corresponding to the pressure measured by the water level sensor 170.

In various embodiments, the washing machine 100 may include a vibration sensor (not shown) for detecting vibration of the tub 120. The vibration sensor may be installed in various positions (e.g., in the tub 120 or the cabinet 101) at which to detect vibration of the tub 120.

The vibration sensor may include an acceleration sensor for measuring 3-axis (X, Y and Z) acceleration of the tub 120. For example, the vibration sensor may be provided as a piezoelectric type, strain gauge type, piezoresistive type, capacitive type, servo type, or optical type acceleration sensor. In addition, the vibration sensor may be provided as various sensors (e.g., gyroscope) capable of measuring vibration of the tub 120.

The vibration sensor may output a sensing value of the vibration of the tub 120. For example, the vibration sensor may output a constant value corresponding to the vibration of the tub 120. The vibration sensor may output a voltage value corresponding to the 3-axis acceleration of the tub 120.

In various embodiments, the vibration sensor 180 may be provided as a micro electro mechanical system (MEMS) sensor. An MEMS is a scheme developed with the advancement of semiconductor technologies, and the MEMS sensor may be made by deposition, photolithographic patterning and etching processes. The vibration sensor may be formed of various materials such as silicon, polymer, metal or ceramic. The vibration sensor manufactured in the MEMS scheme may have a size in micrometers.

The controller 190 may determine an amount of vibration of the tub 120 based on a vibration signal received from the vibration sensor, and control rotation speed of the driving motor 140 based on the amount of vibration of the tub 120.

For example, the controller 190 may be mounted on a printed circuit board provided on the rear surface of the control panel 110.

The controller 190 may be electrically connected to the control panel 110, the water level sensor 170, the driver 200 (e.g., the water supply valve 152) and the drain valve 162.

The controller 190 may be comprised of hardware such as a control processing unit (CPU), a memory, etc., and software such as a control program. The controller 190 may be implemented to include at least one memory 192 that stores an algorithm for controlling operations of the components in the washing machine 100, and at least one processor 191 for performing the aforementioned operations using the data stored in the at least one memory 192. In this case, the memory 192 and the processor 191 may be implemented in separate chips. Alternatively, the memory 192 and the processor 191 may be implemented in a single chip.

The processor 191 may process output signals from the control panel 110, the water level sensor 170 and/or the driver 200, and include an operation circuit, a memory circuit, and a control circuit, which output control signals to the driver 200, the water supply valve 152 and the drain valve 162 based on the processing results.

The memory 192 may include a volatile memory, such as a static random access memory (S-RAM), a dynamic RAM (D-RAM), or the like, and a non-volatile memory, such as a read only memory (ROM), an erasable programmable ROM (EPROM) or the like.

The controller 190 may control the various components (e.g., the driving motor 140 and the water supplier 150) of the washing machine 100, and automatically drive the respective courses such as water supply, washing, rinsing, dehydrating, etc., according to an indication input to the control panel 110.

For example, the controller 190 may control the driver 200 to control the rotation speed of the driving motor 140, and control the water supply valve 152 of the water supplier 150 to supply water into the tub 120.

Figure 4:
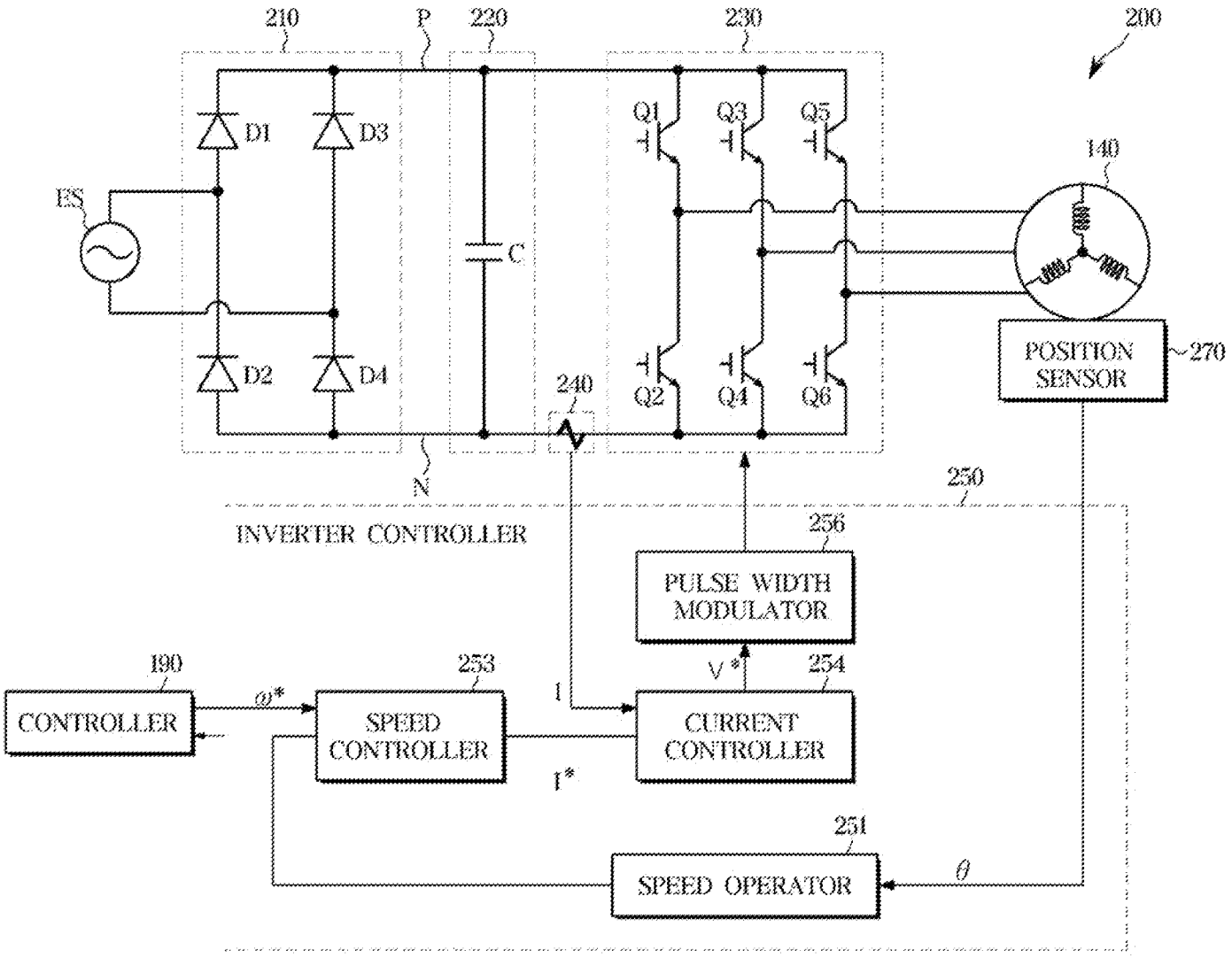
FIG. 4 illustrates an example of a driver for driving a driving motor of a washing machine, according to an embodiment.
Figure 5:
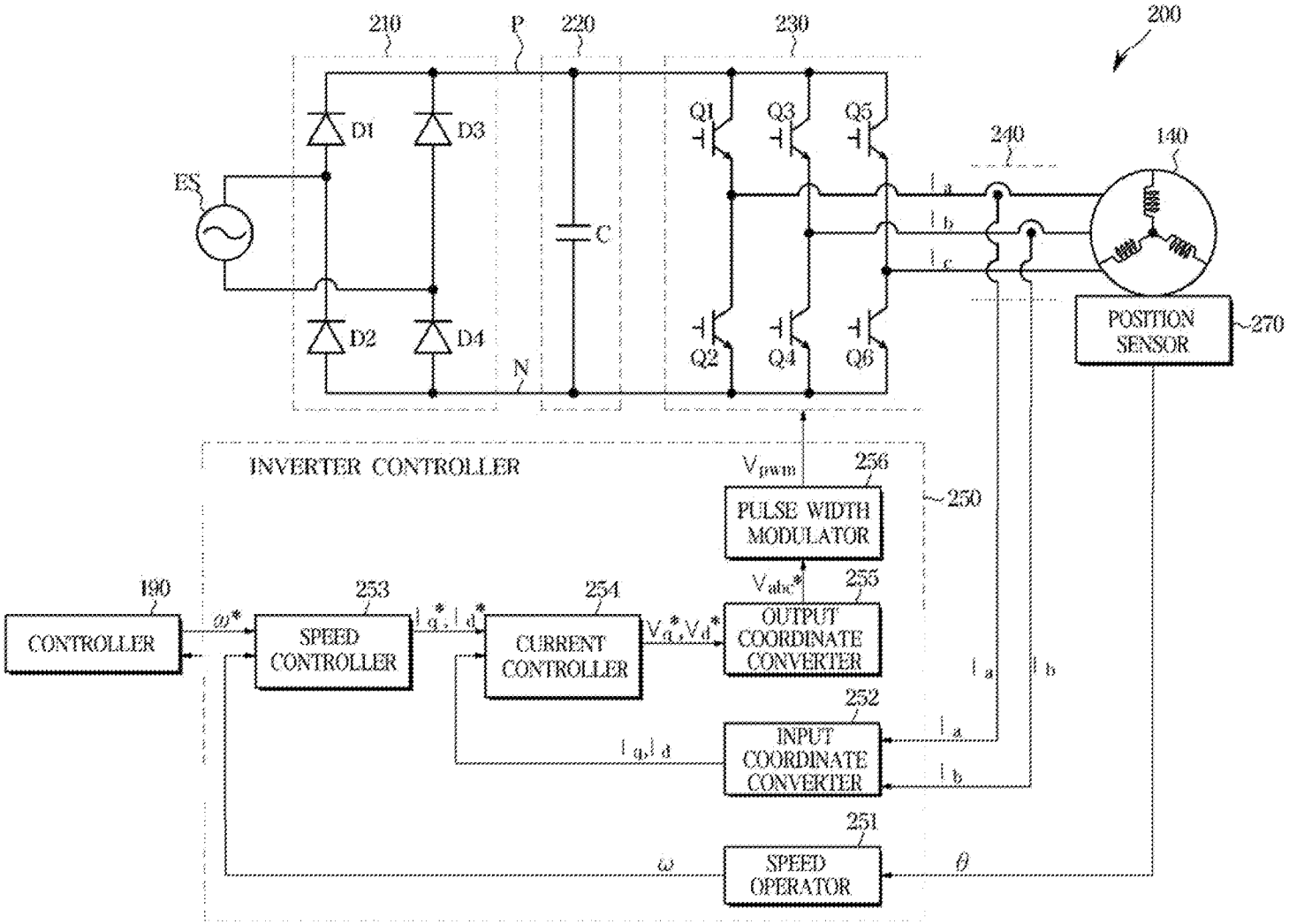
FIG. 5 illustrates another example of a driver for driving a driving motor of a washing machine, according to an embodiment.

FIG. 4 illustrates an example of a driver for driving a driving motor of a washing machine, according to an embodiment. FIG. 5 illustrates another example of a driver for driving a driving motor of a washing machine, according to an embodiment.

Referring to FIGS. 4 and 5, the driver 200 may include a rectifying circuit 210, a direct current (DC) link circuit 220, an inverter circuit 230, a current sensor 240 and/or an inverter controller 250. Furthermore, a position sensor 270 may be arranged on the driving motor 140 for measuring rotational displacement of the rotor (electrical angle of the rotor).

The rectifying circuit 210 may include a diode bridge including a plurality of diodes D1, D2, D3 and D4 to rectify alternate current (AC) power from an external power source (ES).

The DC link circuit 220 may include a DC link capacitor C for storing electrical energy to get rid of ripples of the rectified power and output DC power.

The inverter circuit 230 may include three pairs of switching devices Q1 and Q2, Q3 and Q4, and Q5 and Q6 to convert the DC power from the DC link circuit 220 to DC or AC driving power. The inverter circuit 230 may apply a driving current to the driving motor 140.

The current sensor 240 may measure a total current output from the inverter circuit 230 or measure each of three-phase driving currents, a-phase current, b-phase current and c-phase current output from the inverter circuit 230.

The position sensor 270 may be arranged on the driving motor 140 for measuring rotational displacement of the rotor of the driving motor 140 (e.g., electric angle of the rotor) and output position data $\Theta$ that represents the electric angle of the rotor. The position sensor 270 may be implemented by a hall sensor, an encoder, a resolver, or the like.

The inverter controller 250 may be integrated into the controller 190 or separated from the controller 190.

The inverter controller 250 may include an application specific integrated circuit (ASIC) for outputting a driving signal to the inverter circuit 230 based on e.g., a target speed command $\omega^*$, a driving current value, and the rotational displacement $\Theta$ of the rotor 143. Alternatively, the inverter controller 250 may include a memory for storing a series of instructions for outputting a driving signal based on a target speed command $\omega^*$, a driving current value, and rotational displacement $\Theta$ of the rotor, and a processor for processing the series of instructions stored in the memory.

The structure of the inverter controller 250 may depend on the type of the driving motor 140. In other words, the inverter controller 250 having a different structure may control the driving motor 140 of a different type.

For example, the driving motor 140 is a BLDC motor, the inverter controller 250 may include a speed operator 251, a speed controller 253, a current controller 254 and a pulse width modulator 256, as shown in FIG. 5.

The inverter controller 250 may use pulse width modulation (PWM) to control a DC voltage applied to the BLDC motor. Accordingly, the driving current applied to the BLDC motor may be controlled.

The speed operator 251 may calculate a rotation speed value ω of the driving motor 140 based on the electric angle θ of the rotor of the motor 140. For example, the speed operator 251 may calculate the rotation speed value ω of the driving motor 140 based on a change in electric angle θ of the rotor received from the position sensor 270. In another example, the speed operator 251 may calculate the rotation speed value ω of the driving motor 140 based on a change in driving current value measured by the current sensor 240.

The speed controller 253 may output a current command I* based on a difference between the target speed command ω* of the controller 190 and the rotation speed value ω of the driving motor 140. For example, the speed controller 253 may include a proportional integral controller (PI controller).

The current controller 254 may output a voltage command V* based on a difference between the current command I* output from the speed controller 253 and the current value I measured by the current sensor 240. For example, the current controller 254 may include PI control.

The pulse width modulator 256 may output a PWM control signal Vpwm to control the magnitude of the driving current applied to the driving motor 140 by the inverter circuit 230 based on the voltage command V*.

As such, the inverter controller 250 may control the magnitude of the driving current applied to the driving motor 140 by the inverter circuit 230 based on the target speed command ω* received from the controller 190.

In another example, when the driving motor 140 is a PMSM, the inverter controller 250 may include the speed operator 251, an input coordinate converter 252, the speed controller 253, the current controller 254, an output coordinate converter 255 and the pulse width modulator 256, as shown in FIG. 5.

The inverter controller 250 may use vector control to control the AC voltage applied to the PMSM. Accordingly, the driving current applied to the PMSM may be controlled.

The speed operator 251 may be equivalent to the speed operator 251 shown in FIG. 4.

The input coordinate converter 252 may convert a 3-phase driving current value Iabc into a d-axis current value Id and a q-axis current value Iq (hereinafter, a d-axis current and a q-axis current) based on the electric angle θ of the rotor. In this case, the d-axis may refer to an axis in a direction corresponding to a direction of a magnetic field produced by the rotor of the driving motor 140. The q-axis may refer to an axis in a direction ahead by 90 degrees of a direction of the magnetic field produced by the rotor of the driving motor 140.

The speed controller 253 may calculate a q-axis current command Iq* to be applied to the driving motor 140 based on a difference between the target speed command ω* and the rotation speed value ω of the driving motor 140. The speed controller 253 may determine a d-axis current command Id*.

The current controller 254 may determine a q-axis voltage command Vq* based on a difference between the q-axis current command Iq* output from the speed controller 253 and the q-axis current value Iq output from the input coordinate converter 252. The current controller 254 may determine a d-axis voltage command Vd* based on a difference between the d-axis current command Id* and the d-axis current value Id.

The output coordinate converter 255 may convert a dq-axis voltage command Vdq* into 3-phase voltage commands (an a-phase voltage command, a b-phase voltage command, and a c-phase voltage command) Vabc* based on the electric angle Θ of the rotor of the driving motor 140.

The pulse width modulator 256 may output a PWM control signal Vpwm to control the magnitude of the driving current applied to the driving motor 140 by the inverter circuit 230 based on the 3-phase voltage command Vabc*.

As such, the inverter controller 250 may control the magnitude of the driving current applied to the driving motor 140 by the inverter circuit 230 based on the target speed command ω* received from the controller 190.

In various embodiments, the driver 200 may include a voltage sensor (not shown) for measuring a driving voltage applied to the driving motor 140. The driver 200 may further include a power operator (not shown) for computing power to be applied to the driving motor 140 based on a voltage value output from the voltage sensor and a current value output from the current sensor 240, and a power controller (not shown) for outputting a target speed command ω* according to the power computed by the power operator and a target power command output from the controller 190.

The power controller may include a PI controller.

in various embodiments, the controller 190 may output a target power command to the inverter controller 250, which may in turn control the inverter circuit 230 to supply target power to the driving motor 140 based on the target power command. Accordingly, the controller 190 may perform power control and speed control on the driving motor 140.

The controller 190 may provide an electric signal (target speed command) corresponding to a target speed at which to rotate the drum 130 to the driver 200. For example, the memory 192 may store rotation speed (angular velocity) of the drum 130 for washing, rotation speed of the drum for rinsing, and rotation speed of the drum 130 for dehydrating. The processor 191 may provide a target speed command corresponding to a process of a laundry operation (washing, rinsing or dehydrating) to the driver 200.

In various embodiments, the controller 190 may provide a target speed command to measure a weight (i.e., a load) of clothes contained in the drum 130 to the driver 200.

In other words, the controller 190 may perform a weight detection course to measure a weight of clothes (i.e., load(s)) contained in the drum 130.

For example, the controller 190 may repeatedly turn on or off the driving motor 140 to rotate the drum 130 and/or the pulsator 133, and may measure the weight of clothes based on counter electromotive force produced when the driving motor 140 is turned off.

In another example, the controller 190 may provide a target speed command to rotate the drum 130 and/or the pulsator 133 at a first target speed to the driver 200, and measure the weight of clothes based on a time taken until the drum 130 and/or the pulsator 133 reaches the first target speed.

Figure 6:
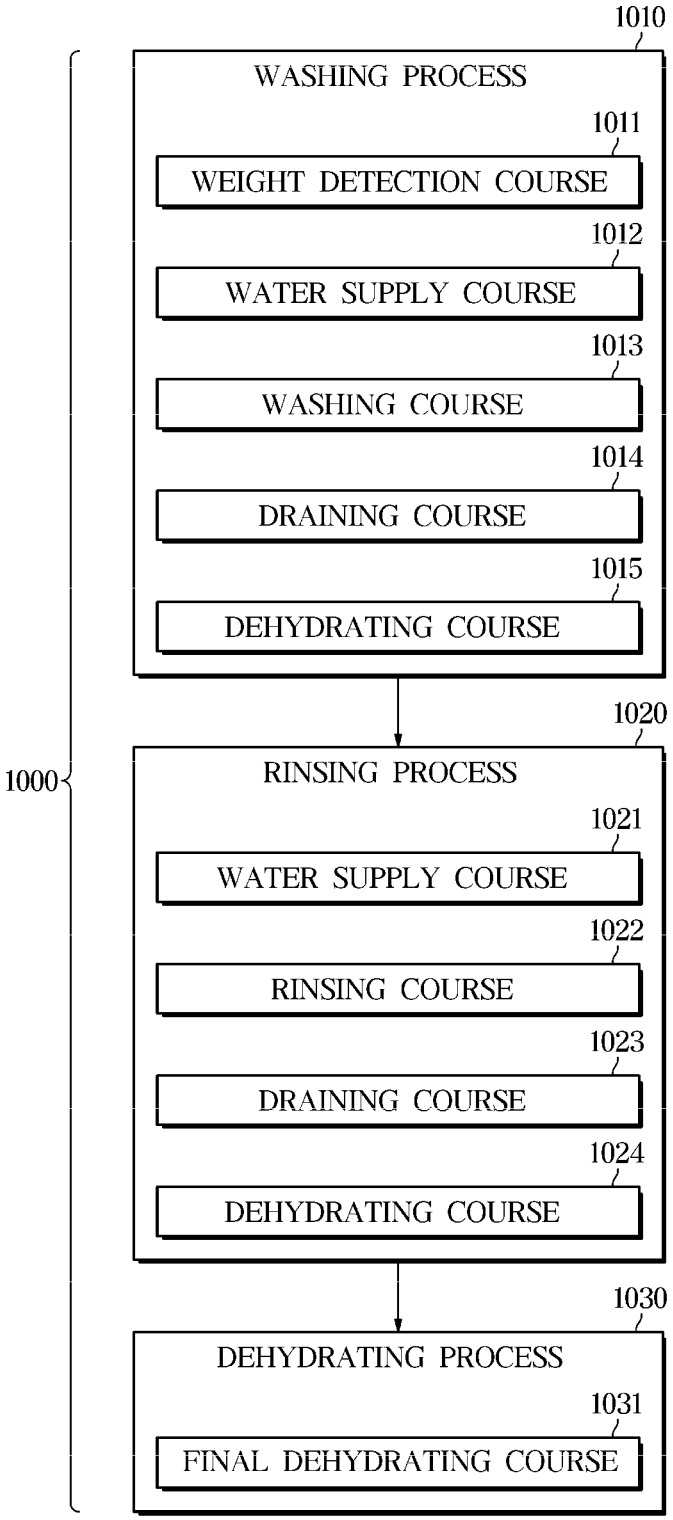
FIG. 6 illustrates an example of a laundry cycle of a washing machine, according to an embodiment.

FIG. 6 illustrates an example of a laundry cycle of a washing machine, according to an embodiment.

Referring to FIG. 6, in an embodiment, a laundry cycle 1000 of the washing machine 100 may be comprised of a washing process 1010, a rinsing process 1020 and a dehydrating process 1030.

The washing machine 100 may perform the washing process 1010, the rinsing process 1020 and the dehydrating process 1030 sequentially according to a user input through the control panel 110.

Clothes may be washed by the washing process 1010. Specifically, dirt on the clothes may be separated by chemical actions of a detergent and/or mechanical actions such as falling.

The washing process 1010 may include a weight detection course 1011 for measuring a weight of clothes, a water supply course 1012 for supplying water to the tub 120, a washing course 1013 for washing the clothes by rotating the drum 130 at low speed, a draining course 1014 for draining water contained in the tub 120, and a dehydrating course 1015 for separating water from the clothes by rotating the drum 130 at high speed.

Loads contained in the drum 130 may be measured in the weight detection course 1011. Specifically, the controller 190 may control the driving motor 140 to perform the weight detection course and measure loads in the drum 130 based on information about a driving current value obtained by the current sensor 240 and/or information about rotation displacement of the rotor of the driving motor 140 obtained by the position sensor 270.

For example, the controller 190 may control the driver 200 to repeatedly turn on/off the driving motor 140 to perform the weight detection course and measure the loads in the drum 130 based on the value of counter electromotive force produced when the driving motor 140 is turned off.

In another example, the controller 190 may provide a target speed command to rotate the drum 130 and/or the pulsator 133 at the first target speed to the driver 200, and measure loads in the drum 130 based on a time taken until the drum 130 and/or the pulsator 133 reaches the first target speed.

An example of using the driving motor 140 to perform the weight detection course is not, however, limited thereto, and any course that may measure loads in the drum 130 based on a sensing value obtained from the driving motor 140 may correspond to the weight detection course of the disclosure.

In various embodiments, the controller 190 may determine a target water level for the water supply course 1012 based on a load value (hereinafter, a first weight value) in the drum 130 obtained from the weight detection course performed before the start of the water supply 1012. The controller 190 may store information about the first weight value in the memory 192.

In the water supply course 1012, the controller 190 may control the water supply valve 152 to be opened to supply water into the tub 120, and accordingly, the detergent contained in the detergent container 156 may be supplied to the tub 120 by the detergent supplier 155.

The controller 190 may open the water supply valve 152 until the water level in the tub 120 reaches the target water level determined in the weight detection course 1011.

As will be described later, the controller 190 may control the driving motor 140 to perform the weight detection course during the process of the water supply course 1012 based on a preset condition being satisfied.

In an embodiment, the controller 190 may control the driving motor 140 to rotate the drum 130 at a preset speed during the water supply course 1012. Accordingly, the clothes in the drum 130 may evenly spread and water may be supplied.

In another embodiment, the controller 190 may control the driving motor 140 to rotate the pulsator 133 at a preset speed during the water supply course 1012. Accordingly, the clothes in the drum 130 may evenly spread and water may be supplied.

When the water level in the tub 120 reaches a target water level, the water supply course 1012 may be terminated and the washing course 1013 may be started.

For the washing course 1013, the controller 190 may control the driver 200 to rotate the driving motor 140 in forward direction or reverse direction. In the case of the front-loading washing machine, the clothes may fall from the upper side to the lower side of the drum 130 due to rotation of the drum 130 and may be washed by the falling, and in the case of the top-loading washing machine, clothes may be washed by centrifugal force produced by rotation of the drum 130.

For the draining course 1014, the controller 190 may control the pump motor driver to rotate the pump motor 164. The rotation of the pump motor 164 may cause a difference in pressure between both sides of the drain pump 163, allowing the water in the tub 120 to be drained to the outside.

For the dehydrating course 1015, the controller 190 may control the driver 200 to rotate the driving motor 140 at high speed. Due to the high-speed rotation of the drum 130, water may be separated from the clothes contained in the drum 130. Furthermore, to discharge the remaining water in the tub 120 to the outside during the dehydrating course 1015, the controller 190 may control the pump motor driver to rotate the pump motor 164.

The rotation speed of the drum 130 may gradually increase during the dehydrating course 1015. For example, the controller 190 may control the driver 200 to rotate the driving motor 140 at a first rotation speed, and control the driving motor 140 so that the rotation speed of the driving motor 140 increases to a second rotation speed based on a change in driving current of the driving motor 140 while the driving motor 140 is rotated at the first rotation speed. The controller 190 may control the driving motor 140 so that the rotation speed of the driving motor 140 increases to a third rotation speed or the rotation speed of the driving motor 140 decreases to the first rotation speed based on a change in driving current of the driving motor 140 while the driving motor 140 is rotated at the second rotation speed.

The clothes may be rinsed by the rinsing process 1020. Specifically, the remnants of the detergent or dirt on the clothes may be washed by water.

The rinsing process 1020 may include a water supply course 1021 for supplying water to the tub 120, a rinsing course 1022 for rinsing the clothes by driving the drum 130, a draining course 1023 for draining water contained in the tub 120, and a dehydrating course 1024 for separating water from the clothes by driving the drum 130.

The water supply course 1021, draining course 1023 and dehydrating course 1024 of the rinsing process 1020 may correspond to the water supply course 1012, draining course 1014 and dehydrating course 1015 of the washing process 1010. During the rinsing process 1020, the water supply course 1021, the rinsing course 1022, the draining course 1023 and the dehydrating course 1024 may be performed one or multiple times.

In an embodiment, a target water level for the water supply course 1021 of the rinsing process 1020 may be equivalent to a target water level for the water supply course 1012 of the washing process 1010.

In another embodiment, the target water level for the water supply course 1021 may be newly estimated by performing the weight detection course again before the water supply course 1021 is performed in the rinsing process 1020.

The clothes may be dehydrated by the dehydrating process 1030. Specifically, water may be separated from the clothes by high-speed rotation of the drum 130, and the separated water may be discharged out of the washing machine 100.

The dehydrating process 1030 may include a final dehydrating course 1031 to separate water from the clothes by rotating the drum 130 at high speed. With the final dehydrating course 1031, the last dehydrating course 1024 of the rinsing process 1020 may be skipped.

For the final dehydrating course 1031, the controller 190 may control the driver 200 to rotate the driving motor 140 at high speed. Due to the high-speed rotation of the drum 130, water may be separated from the clothes contained in the drum 130. Furthermore, to discharge the remaining water in the tub 120 to the outside during the final dehydrating course 1031, the controller 190 may control the pump motor driver to rotate the pump motor 164.

The rotation speed of the driving motor 140 may gradually increase during the final dehydrating course 1031.

As the operation of the washing machine 100 is finished with the final dehydrating course 1031, a performance time of the final dehydration 1031 may be longer than a performance time of the dehydration course 1015 or 1024 of the washing process 1010 and the rinsing process 1020.

Figure 7:
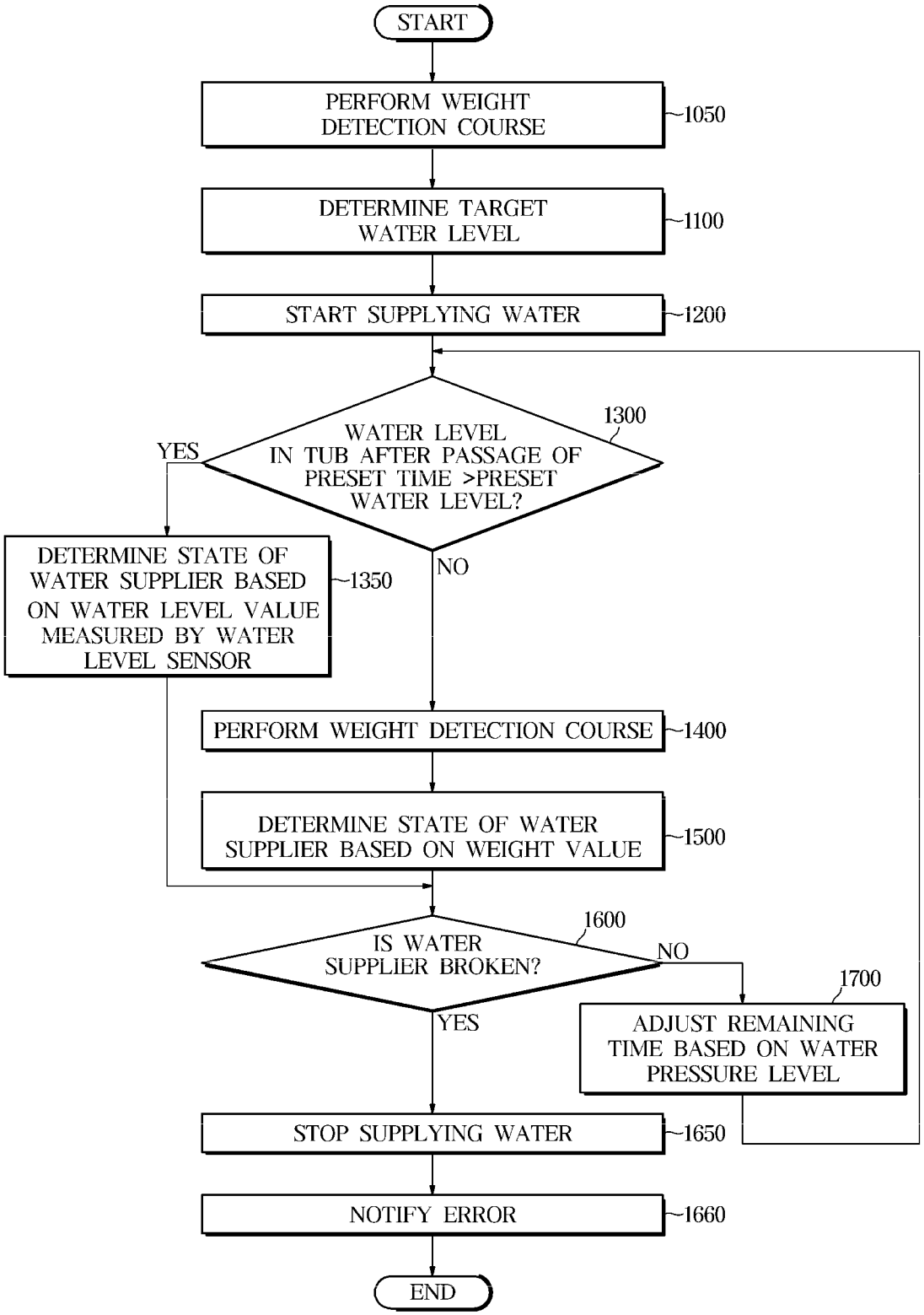
FIG. 7 is a flowchart illustrating an example of a method of controlling a washing machine, according to an embodiment.

FIG. 7 is a flowchart illustrating an example of a method of controlling a washing machine, according to an embodiment.

Referring to FIG. 7, the controller 190 may control the driving motor 140 to perform the weight detection course 1011 before the start of the water supply course 1012, i.e., before water supply is started, in 1050. For convenience of explanation, the weight detection course 1011 performed before the start of water supply will now be referred to as a first weight detection course.

The controller 190 may determine a target water level based on a weight value (hereinafter, a first weight value) obtained from the first weight detection course 1011, in 1100. For example, the controller 190 may determine a higher water level the larger the first weight value.

The water supply course 1012 may be started after the first weight detection course 1011.

The controller 190 may control the water supplier 150 to start water supply based on the determined target water level, in 1200.

Specifically, the controller 190 may perform the water supply course 1012 by opening the water supply valve 152.

In an embodiment, the controller 190 may store information about the first weight value obtained from the first weight detection course 1011 and information about an opening time of the water supply valve 152.

The controller 190 may determine a state of the water supplier 150 based on the water level in the tub 120 measured by the water level sensor 170 at a time when a preset time passes after the start of water supply.

In an embodiment, the controller 190 may determine a state of the water supplier 150 in 1350, based on the passage of the preset time after the start of water supply, the water level in the tub 120 measured by the water level sensor 170 reaching a preset water level (yes) in 1300), and the water level value measured by the water level sensor 170.

In an embodiment, the controller 190 may determine a water pressure level of the water supplier 150 based on a change in water level value measured by the water level sensor 170 per unit time. For example, the controller 190 may determine a larger water pressure level of the water supplier 150 as the change in water level value measured by the water level sensor 170 per unit time increases.

Furthermore, the controller 190 may adjust a remaining time of a laundry cycle displayed on the display 112 based on the water pressure level of the water supplier 150. For example, the controller 190 may increase the remaining time of the laundry cycle as the water pressure level of the water supplier 150 decreases.

In the meantime, the water supplier 150 having normally operated in an early stage of water supply may not normally operate after the water level in the tub 20 reaches a preset water level.

In an embodiment, the controller 190 may determine that there is an error in the water supplier 150 when a change in water level value measured by the water level sensor 170 per unit time is equal to or smaller than a threshold.

When it is determined that there is an error in the water supplier 150 (yes) in 1600, the controller 190 may turn off the water supply valve 152 to stop supplying water in 1650 and operate the drain pump. When it is determined that there is an error in the water supplier 150, the controller 190 may control the display 112 to output a visual indication (hereinafter, an error indication) to indicate that there is an error in the water supplier 150, in 1660.

The preset water level may correspond to a reset water level. Furthermore, the preset time may be set based on a time taken until the water level in the tub 120 reaches the preset water level, when the water supplier 150 having a normal water pressure level supplies water into the tub 120. For example, the preset time may be set to about 4 minutes, without being limited thereto, and may be changed based on the preset water level and/or an area of the tub 120.

Figure 8:
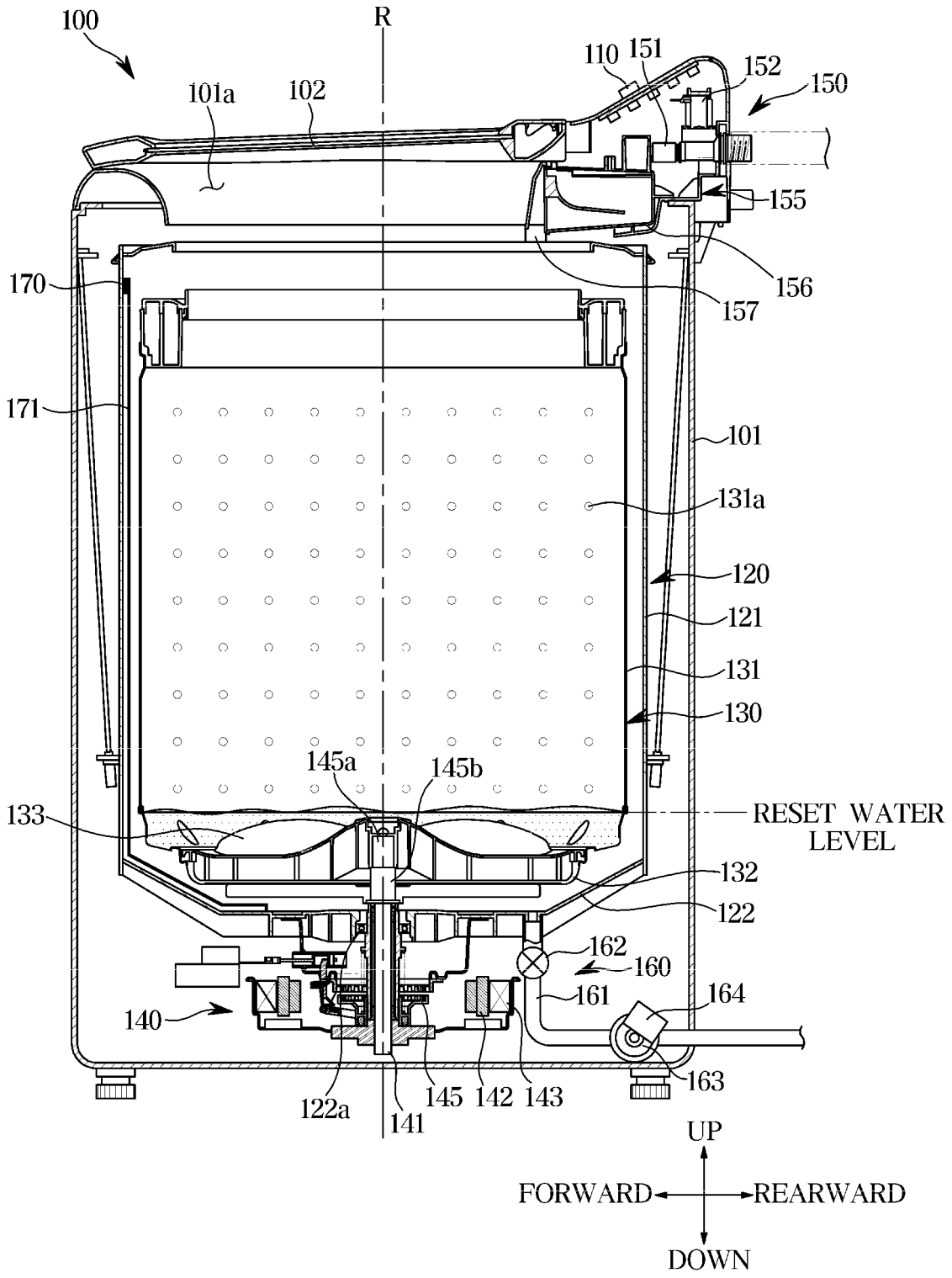
FIG. 8 illustrates a water level in a tub reaching a reset water level during a water supply course of a washing machine, according to an embodiment.

FIG. 8 illustrates a water level in a tub reaching a reset water level during a water supply course of a washing machine, according to an embodiment.

Referring to FIG. 8, the reset water level may be a threshold water level with low confidence of measurement obtained by the water level sensor 170, and the value of the reset water level may be stored in the memory 192 in advance. For example, the reset water level may be set to about 5 mm to about 30 mm for the tub 120.

In another example, in the case of the top-loading washing machine, the reset water level may be set to a water level around a demarcation line of the tub 120 and the drum 130.

In other words, the reset water level may be set regardless of the target water level obtained from the first weight detection course 1011 and may be lower than the target water level.

Figure 9:
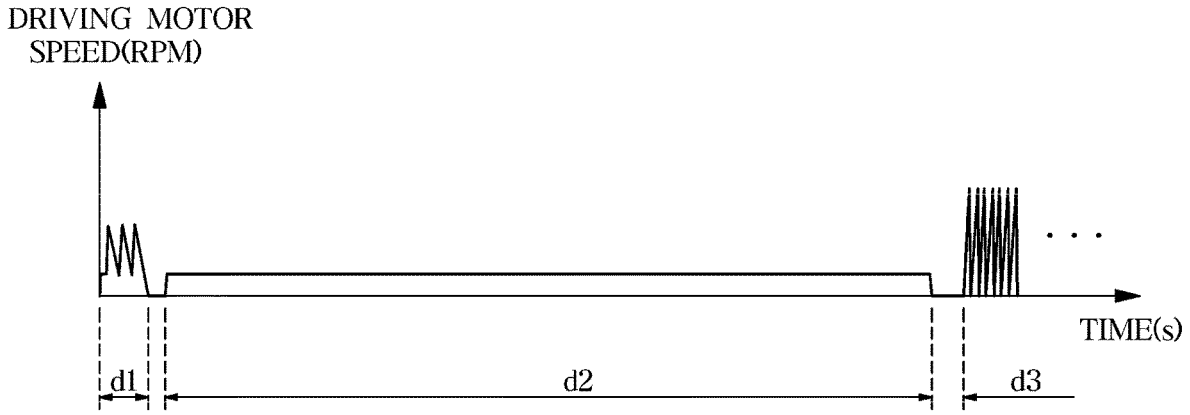
FIG. 9 illustrates an example of the speed of a driving motor for rotating a drum when a washing machine is installed in a high water pressure environment, according to an embodiment.

FIG. 9 illustrates an example of the speed of a driving motor for rotating a drum when a washing machine is installed in a high water pressure environment, according to an embodiment.

Referring to FIG. 9, the driving motor 140 may be repeatedly turned on and off to measure a load in the tub 120 in a first weight detection course d1.

Furthermore, during the water supply course 1012 (d2), the driving motor 140 may constantly rotate the drum 30 at a preset speed.

After this, based on the water level in the tub 120 reaching the target water level, the water supply course 1012 may be terminated and the washing course 1013 may be started. During the washing course 1013 (d3), the driving motor 140 may be rotated based on a control signal of the controller 190 to wash clothes.

In various embodiments, the driving motor 140 may not be rotated during the water supply course d2.

According to the disclosure, when the water level in the tub 120 measured by the water level sensor 170 after the passage of a preset time after the start of water supply reaches a preset water level, it may be determined that the water supplier 150 is normally operated. Furthermore, according to the disclosure, when it is determined that the water supplier 150 is normally operated, a water pressure level of the water supplier 150 may be determined based on the measurement of the water level sensor 170, and an accurate time required for the laundry cycle may be provided to the user by adjusting the remaining time displayed on the display 112 depending on the water pressure level.

On the other hand, according to the traditional technology, the water level in the tub 120 is determined depending on only the measurement of the water level sensor 170, so it may be determined that there is an error in the water supplier 150 and accordingly, the laundry cycle may be terminated or an error indication may be output even while water is being actually supplied.

For example, because changes in water level may not be correctly measured when the water level in the tub 120 is lower than the reset water level, it may be determined that the water supplier 150 has an error even before the water level in the tub 120 reaches the preset water level (e.g., the reset water level) when the washing machine 100 is installed in an environment in which the external water supply source has an insufficient water pressure (hereinafter, a low water pressure environment), and accordingly water supply may be terminated or an error indication may be output.

Hence, users who install the washing machine 100 in the low water pressure environment may have less confidence in the washing machine 100 because of often termination of a laundry cycle and output of the error indication.

Turning back to FIG. 7, the controller 190 may control the driving motor 140 to perform a weight detection course (hereinafter, a second weight detection course) in 1400, based on the passage of a preset time after the start of water supply and failure of the water level in the tub 120 to reach the preset water level (no) in 1300.

The second weight detection course may be different from the first weight detection course in that the second weight detection course is performed during the supply of water. In other words, the controller 190 may control the driving motor 140 to perform the first weight detection course while the water supply valve 152 is closed, and control the driving motor 140 to perform the second weight detection course while the water supply valve 152 is opened.

The controller 190 may determine a state of the water supplier 150 based on a weight value (hereinafter, a second weight value) obtained from the second weight detection course, in 1500.

For example, the controller 190 may determine a state of the water supplier 150 based on a difference between the first weight value and the second weight value.

Figure 10:
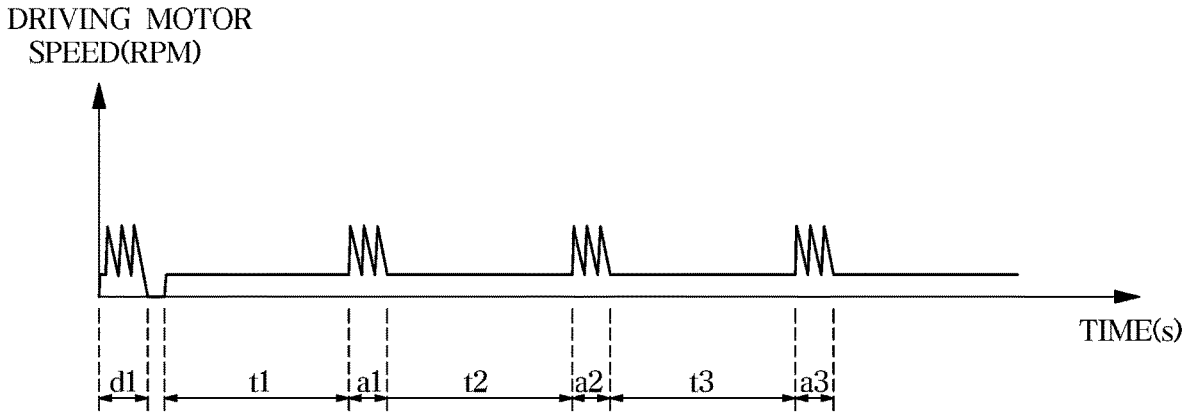
FIG. 10 illustrates an example of the speed of a driving motor for rotating a drum when a washing machine is installed in a low water pressure environment, according to an embodiment.
Figure 11:
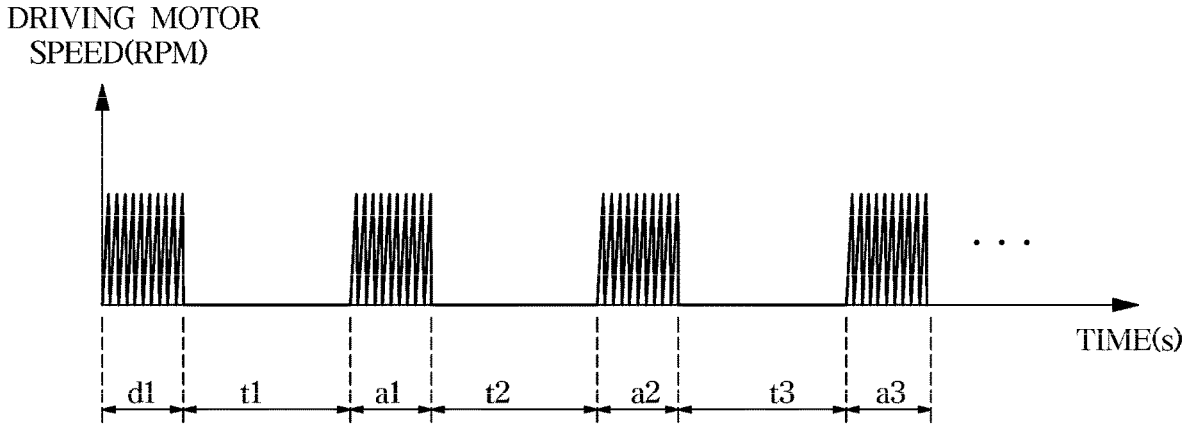
FIG. 11 illustrates an example of the speed of a driving motor for rotating a pulsator when a washing machine is installed in a low water pressure environment, according to an embodiment.

FIG. 10 illustrates an example of the speed of a driving motor for rotating a drum when a washing machine is installed in a low water pressure environment, according to an embodiment. FIG. 11 illustrates an example of the speed of a driving motor for rotating a pulsator when a washing machine is installed in a low water pressure environment, according to an embodiment.

Referring to FIGS. 10 and 11, the controller 190 may control the driving motor 140 to perform the first weight detection course d1 before the start of water supply, and obtain the first weight value during the first weight detection course d1.

As shown in FIG. 10, the driving motor 140 during the supply of water may be connected to the drum 130, or as shown in FIG. 11, the driving motor 140 during the supply of water may be connected to the pulsator 133.

The controller 190 may control the driving motor 140 to perform a second weight detection course a1 unless the water level in the tub 120 measured by the water level sensor 170 reaches the preset water level after the passage of a preset time t1 after the start of water supply.

The controller 190 may obtain the second weight value during the second weight detection course a1 and determine a state of the water supplier 150 based on a difference between the first weight value and the second weight value.

FIG. 12 illustrates an example of states of a water supplier depending on difference values between weight values.

Referring to FIG. 12, the controller 190 may determine that the water supplier 150 is broken when a difference f between the first weight value and the second weight value is smaller than a first threshold V1.

Specifically, when the water level in the tub 120 has not reached the preset water level for a preset time after the start of water supply, and there is little change in weight in the tub 120, water may be estimated as not being supplied into the tub 120 so it may be determined that the water supplier 150 is broken.

In various embodiments, the controller 190 may determine that the water pressure level of the water supplier 150 is a first level corresponding to a low water pressure when the difference f between the first weight value and the second weight value is greater than the first threshold V1 and smaller than a second threshold V2.

Similarly, the controller 190 may determine that the water pressure level of the water supplier 150 is a second level corresponding to a low water pressure when the difference f between the first weight value and the second weight value is greater than the second threshold V2 and smaller than a third threshold V3, and determine that the water pressure level of the water supplier 150 is a third level corresponding to a low water pressure when the difference f between the first weight value and the second weight value is greater than the third threshold V3 and smaller than a fourth threshold V4.

In this case, the first level may be smaller than the second level, and the second level may be smaller than the third level.

In other words, the controller 190 may determine the water pressure level of the water supplier 150 to be an n-th level based on the difference f between the first weight and the second weight belonging to a preset n-th range.

According to the disclosure, when the washing machine 100 is installed in a low water pressure environment, termination of water supply or output of an error indication due to determination that there is an error in the water supplier 150 despite the fact that water is being actually supplied into the tub 120 may be prevented.

Figure 13:
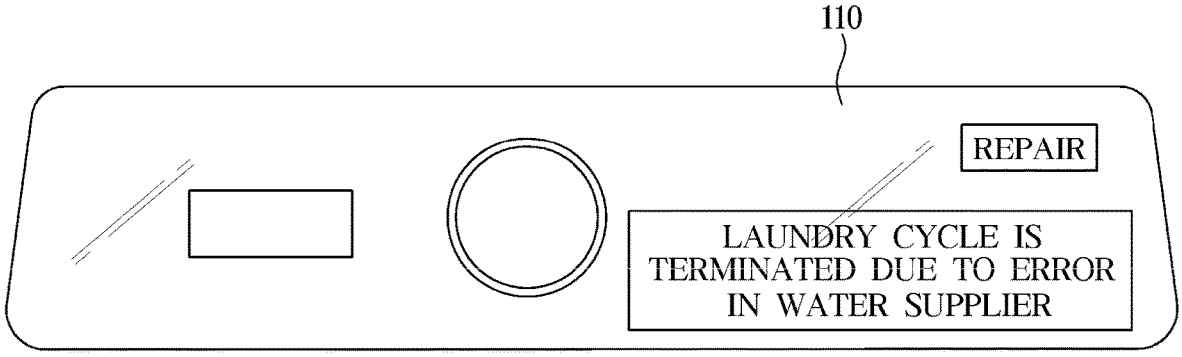
FIG. 13 illustrates an example of a visual indication output on a display when it is determined that there is an error in a water supplier of a washing machine, according to an embodiment.

FIG. 13 illustrates an example of a visual indication output on a display when it is determined that there is an error in a water supplier of a washing machine, according to an embodiment.

The controller 190 may control the water supplier 150 to stop supplying water in 1650 when it is determined that the water supplier 150 is broken (yes) in 1600. Furthermore, the controller 190 may control the display 112 to output a visual indication indicating an error in the water supplier 150 in 1660, when it is determined that the water supplier 150 is broken (yes) in 1600.

Specifically, the controller 190 may control the water supplier 150 to stop supplying water based on the difference f between the first weight value obtained from the first weight detection course d1 and the second weight value obtained from the second weight detection course a1 being equal to or smaller than the preset value V1.

Furthermore, the controller 190 may control the display 112 to output a visual indication indicating an error in the water supplier 150 based on the difference f between the first weight value obtained from the first weight detection course d1 and the second weight value obtained from the second weight detection course a1 being equal to or smaller than the preset value V1.

Referring to FIG. 13, the display 112 may output text such as "laundry cycle is terminated because of error in water supplier", or output text such as "repair" to notify the user that the water supplier 150 needs to be repaired.

The visual indication indicating an error in the water supplier 150 is not, however, limited thereto, and may be implemented in various forms such as text, figures and/or pictures.

Figure 14:
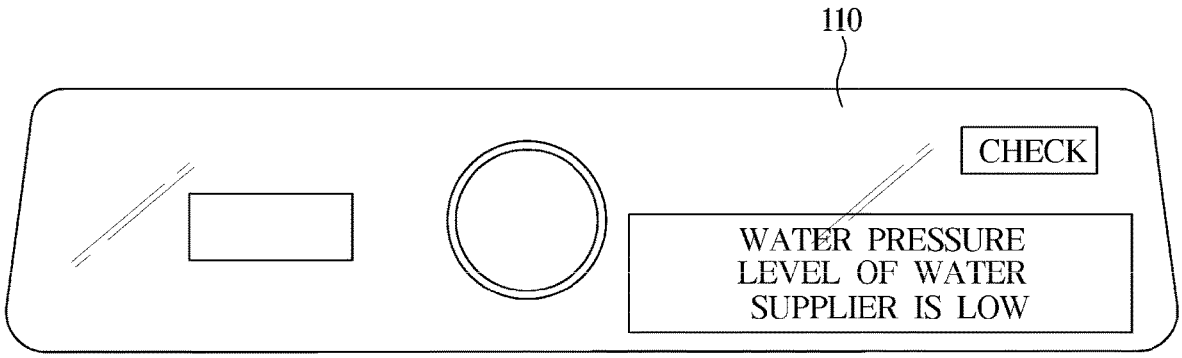
FIG. 14 illustrates an example of a visual indication output on a display when it is determined that a water pressure level of a water supplier of a washing machine is low, according to an embodiment.

FIG. 14 illustrates an example of a visual indication output on a display when it is determined that a water pressure level of a water supplier of a washing machine is low, according to an embodiment.

In various embodiments, when it is determined that the water supplier 150 is not broken (no) in 1600, the display 112 may be controlled to output a visual indication indicating a low water pressure of the water supplier 150 based on the water pressure level of the water supplier 150. For example, the controller 190 may control the display 112 to output a visual indication indicating the low water pressure of the water supplier 150 based on the water pressure level of the water supplier 150 corresponding to a preset level (e.g., the first level). The visual indication indicating the low water pressure of the water supplier 150 is different from an error indication, and the user may check through the visual indication indicating the low water pressure of the water supplier 150 that the water pressure of the water supplier 150 is low.

Referring to FIG. 14, the display 112 may output text such as "water supplier has low water pressure level", or output text such as "check" to notify the user that the water supplier 150 needs to be checked.

The visual indication indicating the low water pressure of the water supplier 150 is not, however, limited thereto, and may be implemented in various forms such as text, figures and/or pictures.

Figure 15:
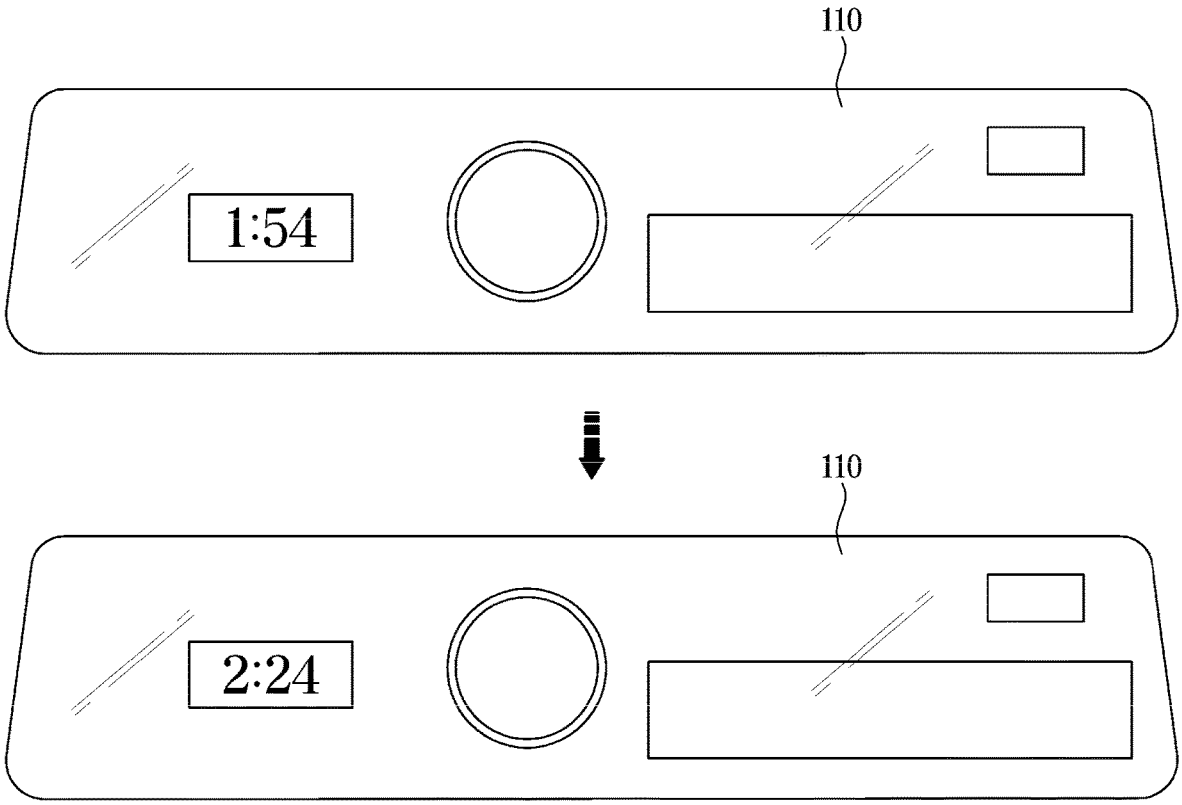
FIG. 15 illustrates adjustment of a remaining time of a laundry cycle displayed on a display of a washing machine, according to an embodiment.

FIG. 15 illustrates adjustment of a remaining time of a laundry cycle displayed on a display of a washing machine, according to an embodiment.

When it is determined that the water supplier 150 is not broken (no) in 1600, the controller 190 may adjust the remaining time required for the laundry cycle based on the water pressure level of the water supplier 150 in 1700.

For example, the controller 190 may adjust the remaining time displayed on the display 112 based on the magnitude of the difference f between the first weight value and the second weight value.

Referring to FIG. 15, it may be seen that the remaining time displayed on the display 112 increases from 1 hour 54 minutes to 2 hours 24 minutes.

Furthermore, when it is determined that the water supplier 150 is not broken (no) in 1600, the controller 190 may control the water supplier 150 to continue to supply water until the water level in the tub 120 reaches a target water level. In other words, when it is determined that the water supplier 150 is not broken (no) in 1600, the controller 190 may continue to supply water by keeping the water supply valve 152 in the open state open.

In various embodiments, the controller 190 may receive a user input to select a laundry course through the control panel 110, and control each component of the washing machine 100 to perform the laundry course corresponding to the received user input.

In this case, the controller 190 may control the display 112 to display a required time for the laundry cycle corresponding to the laundry course selected by the user. A default required time corresponding to each of the plurality of laundry courses may be preset and stored in the memory 192.

For example, a default required time corresponding to a first laundry course may set to 50 minutes, and a default required time corresponding to a second laundry course may be set to 60 minutes.

The controller 190 may determine how much more the remaining time is to be increased based on the magnitude of the difference f between the first weight value and the second weight value.

For example, the controller 190 may increase the remaining time by a first preset time when the difference f between the first weight value and the second weight value is greater than the first threshold V1 and smaller than the second threshold V2, and increase the remaining time by a second preset time when the difference f between the first weight value and the second weight value is greater than the second threshold V2 and smaller than the third threshold V3. Furthermore, the controller 190 may increase the remaining time by a third preset time when the difference f between the first weight value and the second weight value is greater than the third threshold V3 and smaller than a fourth threshold V4.

In this case, the first preset time may be longer than the second preset time, and the second preset time may be longer than the third preset time. For example, the first preset time may be about 50 minutes, the second preset time may be about 40 minutes, and the third preset time may be about 30 minutes.

Although not shown in FIG. 7, in various embodiments, the washing machine 100 may provide various kinds of feedback to the user based on the water pressure level.

In various embodiments, when a laundry course is selected by the user, the washing machine 100 may control the display 112 to display a default required time corresponding to the selected laundry course before the laundry course is started, i.e., before the user presses a course start button. The user may check the required time for the laundry course selected by the user and select the most suitable laundry course.

Accordingly, the washing machine 100 may adjust a default required time corresponding to each of the plurality of laundry courses based on the water pressure level.

For example, the controller 190 may store information about the water pressure level of the water supplier 150, and then may control the display 112 to display the default required time adjusted according to the water pressure level when a new laundry cycle begins.

For example, when the default required time of the first laundry course is set to 50 minutes and a water pressure level of the water supplier 150 is determined to be the first level in the previous laundry cycle, the controller 190 may control the display 112 to display a default required time of 100 minutes based on the first laundry course selected by the user.

According to the disclosure, a new weight detection course is performed during the supply of water, making it possible to correctly determine whether water is being actually supplied into the tub 120 and thus facilitating convenience of the user who installed the washing machine 100 in a low water pressure environment.

Furthermore, according to the disclosure, a correct water pressure level of the water supplier 150 may be determined even before the water level in the tub 120 reaches the preset water level (e.g., the reset water level) and then a required time for a laundry cycle may be provided for the user by reflecting the water pressure level, thereby facilitating the user convenience.

Moreover, according to the disclosure, a default required time corresponding to a laundry course may be adjusted by reflecting the water pressure level of the water supplier 150, allowing the user to perceive an accurate time required for the laundry cycle.

Turning back to FIG. 7, the controller 190 may control the driving motor 140 to perform the weight detection course in each preset cycle (no) in 1300 until the water level in the tub 120 reaches the preset water level after water supply begins.

The controller 190 may determine a water pressure level of the water supplier 150 based on the performance of the second weight detection course a1, and perform a weight detection course again (hereinafter, the third weight detection course) based on the water level in the tub 120 being lower than the preset water level at a time when the preset time passes even after the remaining time displayed on the display 112 is adjusted based on the water pressure level in 1700.

Turning back to FIGS. 10 and 11, when the water level in the tub 120 fails to reach the preset water level at a time when a preset time t2 passes after the second weight detection course a1 is finished, the controller 190 may control the driving motor 140 to perform a third weight detection course a2.

Subsequently, the controller 190 may determine a state of the water supplier 150 based on a difference between a third weight value obtained from the third weight detection course a2 and the second weight value obtained from the second weight detection course a1.

Similarly, when the water level in the tub 120 fails to reach the preset water level at a time when a preset time t3 passes after the third weight detection course a2 is finished, the controller 190 may control the driving motor 140 to perform a fourth weight detection course a3.

Subsequently, the controller 190 may determine a state of the water supplier 150 based on a difference between a fourth weight value obtained from the fourth weight detection course a3 and the third weight value obtained from the third weight detection course a2.

In various embodiments, the first preset time t1, the second preset time t2 and the third preset time t3 may be different from one another or may be the same. For example, the second preset time t2 may be determined based on a difference between the second weight value obtained from the second weight detection course a1 and the first weight value obtained from the first weight detection course d1. For example, the second preset time t2 may be set to be shorter the larger the difference between the second weight value and the first weight value.

In various embodiments, the controller 190 may determine that there is an error in the water supplier 150 when the number of times of performing the weight detection course after the supply of water exceeds a preset number of times (e.g., 5 times).

In other words, the controller 190 may determine a state of the water supplier 150 based on the difference between weight values obtained from successive weight detection courses, or determine a state of the water supplier 150 based on the number of times of performing the weight detection course after the supply of water.

According to the disclosure, an accurate state of the water supplier 150 may be constantly determined before the water level in the tub 120 reaches the preset water level.

In various embodiments, the controller 190 may repeatedly perform the weight detection course in every preset cycle regardless of the water level in the tub 120.

Accordingly, the washing machine 100 according to an embodiment may determine an accurate state of the water supplier 150 by considering a combination of water level values measured by the water level sensor 170 and weight values obtained from the weight detection courses performed successively.

When a change in water level value measured by the water level sensor 170 and a change in weight value obtained from the weight detection courses performed successively do not correspond to each other, the controller 190 may determine that there is an error in the water level sensor 170 and notify this to the user.

Specifically, when a change in water level value measured by the water level sensor 170 is smaller than a certain value despite the fact that a difference between weight values obtained from the weight detection courses successively performed during the supply of water is larger than a certain value, the controller 190 may control the display 112 to output a visual indication indicating that there is an error in the water level sensor 170.

Furthermore, the controller 190 may estimate a water level based on a difference between the first weight value obtained from the first weight detection course and an n-th weight value obtained from an n-th weight detection course lastly performed.

Accordingly, the controller 190 may determine a water level in the tub 120 through the weight detection course during the supply of water (or during the drain of water) as long as there is an error in the water level sensor 170.

According to the disclosure, the error in the water level sensor 170 may be handled temporarily, and may be quickly determined and notified to the user, thereby increasing the user's feeling of satisfaction.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments are only by way of example, and should not be construed in a limited sense.

What is claimed is:

1. A washing machine comprising:

a tub;

a drum in the tub;

a motor to rotate the drum within the tub;

a water supplier to supply water into the tub;

a water level sensor to measure a water level in the tub; and a controller configured to:

control the motor to perform a first weight detection course which obtains a first weight value before water supply into the tub is started, after performing the first weight detection course, control the water supplier to start the water supply into the tub, while controlling the water supplier to supply water into the tub, based on the water level in the tub measured by the water level sensor being less than a preset water level until a predetermined time has elapsed after the water supply into the tub is started, control the motor to perform a second weight detection course which obtains a second weight value, and based on a difference between the first weight value and the second weight value, control the water supplier to continue or stop the water supply into the tub.

2. The washing machine of claim 1, wherein the controller is configured to determine a state of the water supplier based on the difference between the first weight value and the second weight value.

3. The washing machine of claim 1, further comprising: a display, wherein the controller is configured to control the display to output a visual indication indicating an error in the water supplier based on the difference between the first weight value and the second weight value being equal to or smaller than a preset value.

4. The washing machine of claim 1, wherein the controller is configured to control the water supplier to stop supplying water based on the difference between the first weight value and the second weight value being equal to or smaller than a preset value.

5. The washing machine of claim 1, further comprising: a display on which a remaining time of a laundry cycle being performed by the washing machine is displayed, wherein the controller is configured to adjust the remaining time displayed on the display based on the difference between the first weight value and the second weight value.

6. The washing machine of claim 1, further comprising: a display, wherein the controller is configured to control the display to output a visual indication indicating a low water pressure of the water supplier based on the difference between the first weight value and the second weight value being greater than a first preset value and smaller than a second preset value.

7. The washing machine of claim 1, wherein the controller is configured to control the water supplier to continue to supply water based on the difference between the first weight value and the second weight value being greater than a preset value.

8. The washing machine of claim 1, wherein the controller is configured to control the motor to perform a third weight detection course based on the water level in the tub being less than the preset water level when the predetermined time has elapsed after the second weight detection course is completed.

9. The washing machine of claim 1, wherein the controller is configured to control the motor to perform a weight detection course in every preset cycle until the water level in the tub after the start of water supply reaches the preset water level.

10. The washing machine of claim 1, wherein the controller is configured to determine a state of the water supplier based on the water level value measured by the water level sensor in response to the water level in the tub reaching the preset water level.

11. A method of controlling a washing machine, the washing machine including a tub, a drum in the tub, a motor to rotate the drum within the tub, a water supplier to supply water into the tub, and a water level sensor to measure a water level in the tub, the method comprising:

controlling a motor to perform a first weight detection course which obtains a first weight value before water supply into the tub is started;

after performing the first weight detection course, controlling the water supplier to start the water supply into the tub;

while controlling the water supplier to supply water into the tub, based on the water level in the tub measured by the water level sensor being less than a preset water level until a predetermined time has elapsed after the water supply into the tub is started, controlling the motor to perform a second weight detection course which obtains a second weight value; and based on a difference between the first weight value and the second weight value, controlling the water supplier to continue or stop the water supply into the tub.

12. The method of claim 11, further comprising: determining a state of the water supplier based on the difference between the first weight value and the second weight value.

13. The method of claim 11, further comprising: outputting a visual indication indicating an error in a water supplier based on the difference between the first weight value and the second weight value being equal to or smaller than a preset value.

14. The method of claim 11, further comprising: stopping supplying water based on the difference between the first weight value and the second weight value being equal to or smaller than a preset value.

15. The method of claim 11, further comprising:

displaying a remaining time of a laundry cycle being performed by the washing machine; and adjusting the remaining time based on the difference between the first weight value and the second weight value.

* * * * *